US005369912A

United States Patent [19]

Ginzel et al.

[11] Patent Number: 5,369,912

[45] Date of Patent: Dec. 6, 1994

[54] DOOR AND METHOD FOR OPERATING A DOOR

[75] Inventors: Lothar Ginzel, Schwerte, Germany; Giovanni Bertoldo, Malo/VI, Italy

[73] Assignee: Dorma GmbH + Co. KG, Ennepetal, Germany

[21] Appl. No.: 54,437

[22] Filed: Apr. 27, 1993

[30] Foreign Application Priority Data

Aug. 28, 1991 [IT] Italy ..... VI91 A 000138

[51] Int. Cl.[5] ..... E05B 65/10; E05D 15/30

[52] U.S. Cl. ..... 49/141; 49/252; 49/260; 49/261; 49/506

[58] Field of Search ..... 49/246, 261, 260, 252, 49/250, 141, 139, 13, 506

[56] References Cited

U.S. PATENT DOCUMENTS

| | | | |
|---|---|---|---|
| 2,581,783 | 1/1952 | Bates | 49/141 |
| 3,247,617 | 11/1961 | Catlett | 49/107 |
| 3,354,581 | 11/1967 | Dimmitt et al. | 49/141 |
| 3,445,963 | 5/1969 | Gilbert et al. | 49/141 |
| 3,675,370 | 7/1972 | Catlett | 49/141 X |
| 3,834,081 | 9/1974 | Catlett | 49/360 |
| 4,054,008 | 10/1977 | Phillips | 49/31 |
| 4,063,388 | 12/1977 | Little | 49/141 X |
| 4,078,333 | 3/1978 | Lussier | 49/141 |
| 4,306,377 | 12/1981 | Sterling et al. | 49/260 X |
| 4,721,946 | 1/1988 | Zunkel | 49/13 X |
| 5,127,190 | 7/1992 | Hein et al. | 49/141 X |

FOREIGN PATENT DOCUMENTS 2805973 8/1979 Germany .

*Primary Examiner*—Philip C. Kannan

*Attorney, Agent, or Firm*—Nils H. Ljungman & Associates

[57] ABSTRACT

A door which can be automatically opened and closed can have an additional releasable connection for allowing the door panels to be manually opened by disengaging the door panels from the device for automatically opening and closing the doors. In particular, two-panel doors which execute a combined sliding and rotational motion around a vertical axis of rotation during the closing and opening motion can be configured with such a device to make it possible to use the doors in evacuation and emergency routes, i.e. routes in which a manual force can be applied from inside to open the door panels. Further, so that the door does not remain open, there can also preferably be switches or circuits in the construction which indicate that a manual opening of the door panels has occurred, in which case an electronic signal can be generated to place the drive device in motion, to thereby automatically restore the connection between the door panels and the drive system.

10 Claims, 8 Drawing Sheets

FIG. 2
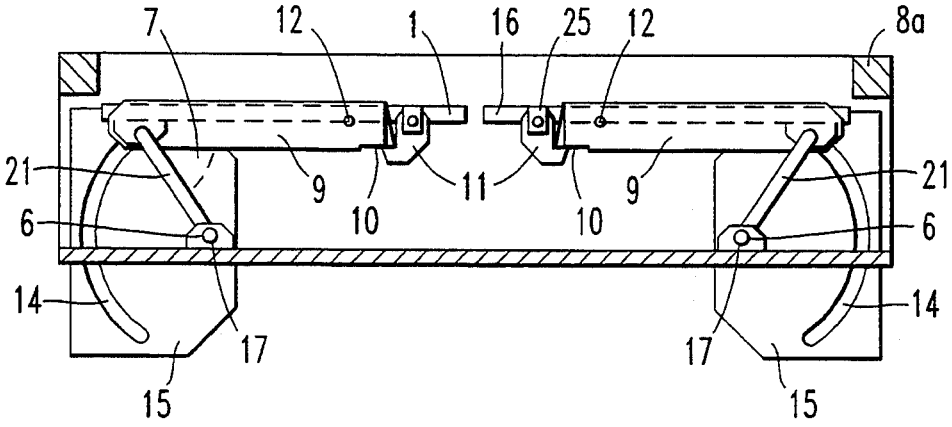
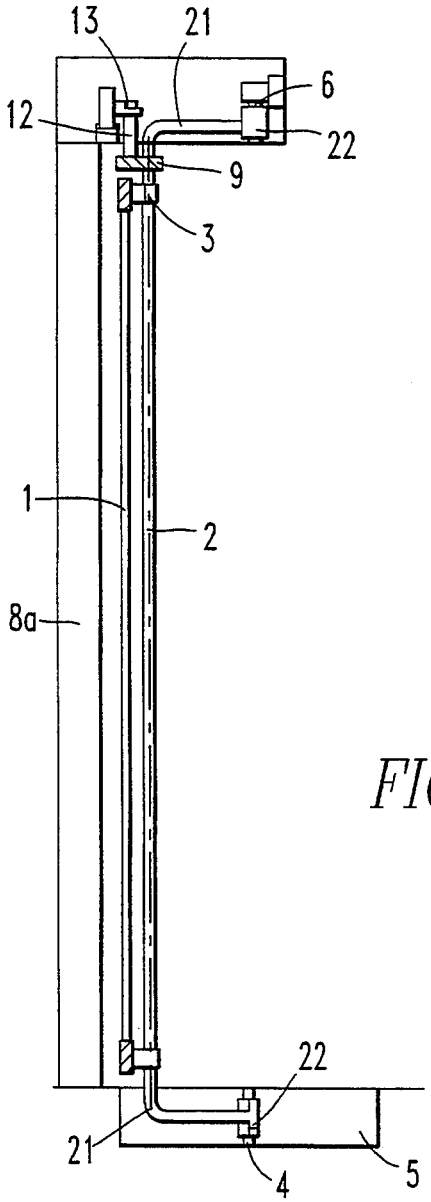
FIG. 3

DOOR AND METHOD FOR OPERATING A DOOR

CONTINUING APPLICATION DATA

This application is a continuation-in-part application of International Application No. PCT/DE92/00707, filed on Aug. 25, 1992, which claims priority from Italian Patent Application No. VI 91 A000138, filed on Aug. 28, 1991. International Application No. PCT/DE92/00707, was pending as of the filing date of U.S. application Ser. No. 08/054,437 and the U.S. was an elected state in International Application No. PCT/DE92/00707.

BACKGROUND OF THE INVENTION

1. Field of the Invention

This invention relates to doors which can be automatically opened upon detecting a person near the door, and then closed again after the person either passes through the door or moves out of the detector range. More particularly, the present invention relates to two-panel doors, in which the opening or closing motion of the panels includes a combination of both a sliding motion and a rotational motion around a vertical axis.

2. Background Information

In areas which are accessible to public traffic, e.g. supermarkets, shopping centers and similar structures, there are frequently doors with sliding and/or pivoting panels. Such doors, after receiving a sensor signal that generally indicates the presence of a person or object near the door, execute an opening motion.

For sliding doors, this opening motion brings the panels into an open position by means of a lateral sliding motion. In such a sliding motion, the panels are retracted into recesses located laterally in relation to the open doorway and specifically provided for that purpose. Such sliding doors have the principal disadvantage that it is necessary to provide these recesses for the lateral motion of the doors. Also, such sliding doors have the disadvantage that they are operated electrically, and an event, such as a fire, which could panic the occupants of the building and put the occupants in danger, could also cause the electricity to possibly be interrupted. After such an interruption of power, it is practically impossible for the occupants of the building to open the doors, which are generally made of glass. Further, such a situation could lead to serious injuries if the glass panels were broken in order to provide access to or from the building.

To eliminate this disadvantage of sliding doors, the prior art discloses two-panel doors with devices by means of which, as the door is opening, the panels execute a combined sliding and rotational motion around a vertical axis of rotation. With such arrangements, the door panels move from a position oriented perpendicular to the door frame and across the passageway, into a position oriented parallel to the door frame and the passageway. With such doors, it is generally not necessary to provide lateral recesses to hold the door panels. However, such doors have the disadvantage of being difficult to equip with safety devices that can be used in the event of panic situations. Such safety devices are essentially necessary to make it possible to open the door panels easily even in the event of a power failure, i.e. by exerting a slight pressure on the door panels from the side of the door facing the inside of the room.

A two-panel door of this type is disclosed in German Laid Open Patent Application No. 28 05 973. On this door, the hinge joints are each located on the free end of a bracket anchored rigidly to the door panel, which bracket projects beyond a broad side of the door panel within a broad side projection. The distance from the axis of rotation of the hinge joints to the broad side of the door and to the vertical edge of the broad side projection of the door panel thereby exceeds one-sixth of the width of the door panel. As a result of this configuration and the orientation of the hinge joints, during the opening motion of each door panel, the vertically-running edge of its vertical door panel facing the opening edge in the vicinity of this opening edge swings toward one side of, namely the outside of the doorway. Simultaneously, in the central area of the door opening, the vertically-running door panel edge pivots to the other side, namely to the inner edge of the doorway. While the pivoting range toward the outside, in the vicinity of the opening edge, restricts the passageway practically not at all, the pivoting movement through the doorway directed toward the inside is significantly reduced in terms of its pivoting space. In an emergency, this door can also be pushed open manually, but because the bracket is connected to the door at a distance from the center of rotation of the door, a pressure must be applied to the door panel near the forward edge of the door panel to open the door, because that is where the force required to open the door panel is the lowest. If pressure were applied against the glass pane in the center of the door panel, a very large force would have to be applied to open the door, on account of the short lever arm. But the proper application of pressure is not apparent or easy for children or older people, and in the event of a panic situation, they might not be able to open the door and thus open the evacuation and emergency route.

OBJECT OF THE INVENTION

The object of the invention is to create an automatically operating door which can also be easily used in evacuation and emergency routes. For this purpose, it must also be possible to be able to easily open the door when necessary, i.e. even during a failure of the power supply. It is also desirable to have the door close automatically after an emergency opening, whether the power supply is on or off.

SUMMARY OF THE INVENTION

This object is achieved by the present invention in a door which can preferably have, near the outer edge of the door panels, i.e. the edges which are closest to the door frame and thus to the load-bearing structure, a vertical axis of rotation. The door panels should preferably be disposed, by either a coincident mounting, or by means of a vertically oriented rod, to allow for a simultaneous pivoting and sliding of the door panel. It is possible to provide a hinged connection of each door panel near its outer edge by means of a vertical shaft. If a continuous rod is used, which rod would extend vertically along the door panel, then it would be preferable to have the ends of the rod bent horizontally perpendicular to the rod, to thereby form a C-shaped structure. These ends can then be installed, in a hinged fashion, on the load bearing structure of the door by means of bearings.

Coincident with one horizontal edge of each openable door panel, there is preferably a cross strut, which can also be connected on its outer end to the rod or to the vertical axis of rotation. During normal operation of the panel, this cross strut is also preferably connected to the panel itself. The drive means of the automatic door can act on the cross strut, thereby making possible an optional translatory motion of the door, either out or in, i.e. allowing the execution of an opening and closing motion. A guidance mechanism for guiding the rotational-sliding motion of the door can be located so as to slide in a slot on the floor. Such a slot can preferably be an arc-shaped curve and can extend over about a 90 degrees angle with respect to the connection of the rod ends.

So that the door can also be used for evacuation and emergency routes, and can thus perform its function even if the power supply fails, there can be provided on the door, at least one device which makes it possible to open the door by simply applying pressure to the inside of the door panels. Thus, in the event of an emergency, and/or a power failure, the door of the present invention can still be opened in a simple manner. In order to be able to allow the door to be opened under such conditions, the door of the present invention can be provided with devices which provide a separable connection. These devices can preferably be located on the cross struts for each panel, and could be used in combination with one another if desired.

One such device which offers an effective separable connection is a permanent magnet. The permanent magnet can be located on either the cross strut or the door panel, and the other of the door panel and the cross-strut can have a metal anchor plate to thereby provide a magnetic holding of the door panel to the cross strut. If a pressure were to be exerted on the inside of the door, the holding force of the magnet would be overcome, and the door panel could be pushed outward. The permanent magnet can also be replaced by an electromagnet. The electromagnet can then be used as the separable device, so that the locking of the door panels can be released from a control panel or by a switch in the event of a panic. In the event of a loss of power, such an electromagnet would essentially be automatically turned off to release the door panel and allow the panel to be pushed open. It would also be possible to release such a device automatically, such as upon the triggering of the fire alarm, so that the release is performed as quickly as possible, without having to possibly wait for someone to manually disconnect the power, which could possibly result in a delayed opening of the doors.

In one configuration of the invention, it is also possible to employ a purely mechanical solution. In this embodiment, a flexible metal plate is installed and interacts with a hook-shaped component which is also mounted flexibly. In this case, too, when pressure is exerted on the door panel from the inside, the elasticity, or spring force of the hook-shaped component is overcome, thereby allowing this component to move out of the way thereby releasing the door panel.

An additional type of fastening is possible by means of a locking clip closure, which is designed so that it unlocks when an appropriate pressure is applied to the door panels. A very economical connection can also be achieved by installing a "VELCRO" closure both to the cross strut and also in the upper portion of the door panel.

If such a door were located in the vicinity of the evacuation and emergency routes which opened to the front of a building, and as described above, the door was automatically opened, this door would essentially be in an open and unlocked position and would result in a safety, or burglary risk for the building. So that this does not happen, there can preferably be a device on the door which indicates the operating status of the door panels. This indication can be achieved economically, for example, by installing an electrical switch, or a contactless sensor on the cross strut, which switch or sensor preferably could indicate the status of the door to the electronic control system of the automatic door, i.e. when the door panel is not in contact with the cross strut, a signal is emitted, which causes an automatic reset process to be initiated, during which the drive means for the automatic door are placed in motion, i.e. the cross strut is moved outwardly, and by means of the separable connection re-engages with the door panel. After the coupling between the door panel and the cross strut has been restored, the door can then be automatically moved back into the closed position. This enables the door to be securely closed so that it is more difficult to open the door from the outside.

Because such doors might possibly be openable from the outside if a sufficient pull could be applied to break the separable connection, additional security devices, such as a key lock could also be installed to permanently lock the doors in the closed position during non-use periods, such as late at night. Such locks would thereby discourage break-in attempts.

One aspect of the invention resides broadly in a door assembly comprising a door device, a first structure having a region with the door device being movable about the region of the first structure in a combination of a translational movement and a rotational movement, a device for providing the combination of the translational movement and the rotational movement of the door device about the region of the first structure to open and close the door device, the door device having a vertical axis of rotation with the door device being further rotatable about the vertical axis of rotation, and the vertical axis of rotation being spaced apart from the region of the first structure.

Another aspect of the invention resides broadly in a door assembly comprising a door device, a first structure having a region with the door device being movable about the region of the first structure, a device for providing a signal to automatically open and close the door device, an apparatus for moving the door device about the region of the first structure to automatically open and close the door device in response to the signal, a device for releasably engaging the door device with the apparatus for moving the door device to move the door device about the first region during engagement of the door device with the apparatus for moving, the door device having a vertical axis of rotation with the vertical axis of rotation being spaced apart from the region of the first structure, and the door device being further rotatable about the vertical axis of rotation upon disengagement of the door device from the apparatus for moving to manually open and close the door device.

Another aspect of the invention resides broadly in a method for operating a door assembly. The method comprises the steps of: providing a door device; providing a first structure having a region with the door device being movable about the region of the first structure in a combination of a translational movement and a rotational movement; providing an apparatus for moving the door device in the combination of the translational movement and the rotational movement of the door device about the region of the first structure to open and close the door device; providing a vertical axis of rotation adjacent the door device; providing an apparatus for further rotating the door device about the vertical axis of rotation, the vertical axis of rotation being spaced apart from the region of the first structure; and moving the door device in the combination of the translational movement and the rotational movement of the door device about the region of the first structure, and in the rotational movement of the door device about the vertical axis of rotation to open and close the door device.

BRIEF DESCRIPTION OF THE DRAWINGS

The invention is schematically illustrated in greater detail on the basis of several embodiments shown in the accompanying drawings, in which:

FIG. 2 shows a plan view of the door assembly in a cross section taken along Line II—II in FIG. 1;

FIG. 3 shows a side view of the door assembly with the door panels in a closed position;

DESCRIPTION OF THE PREFERRED EMBODIMENTS

Figure 1:
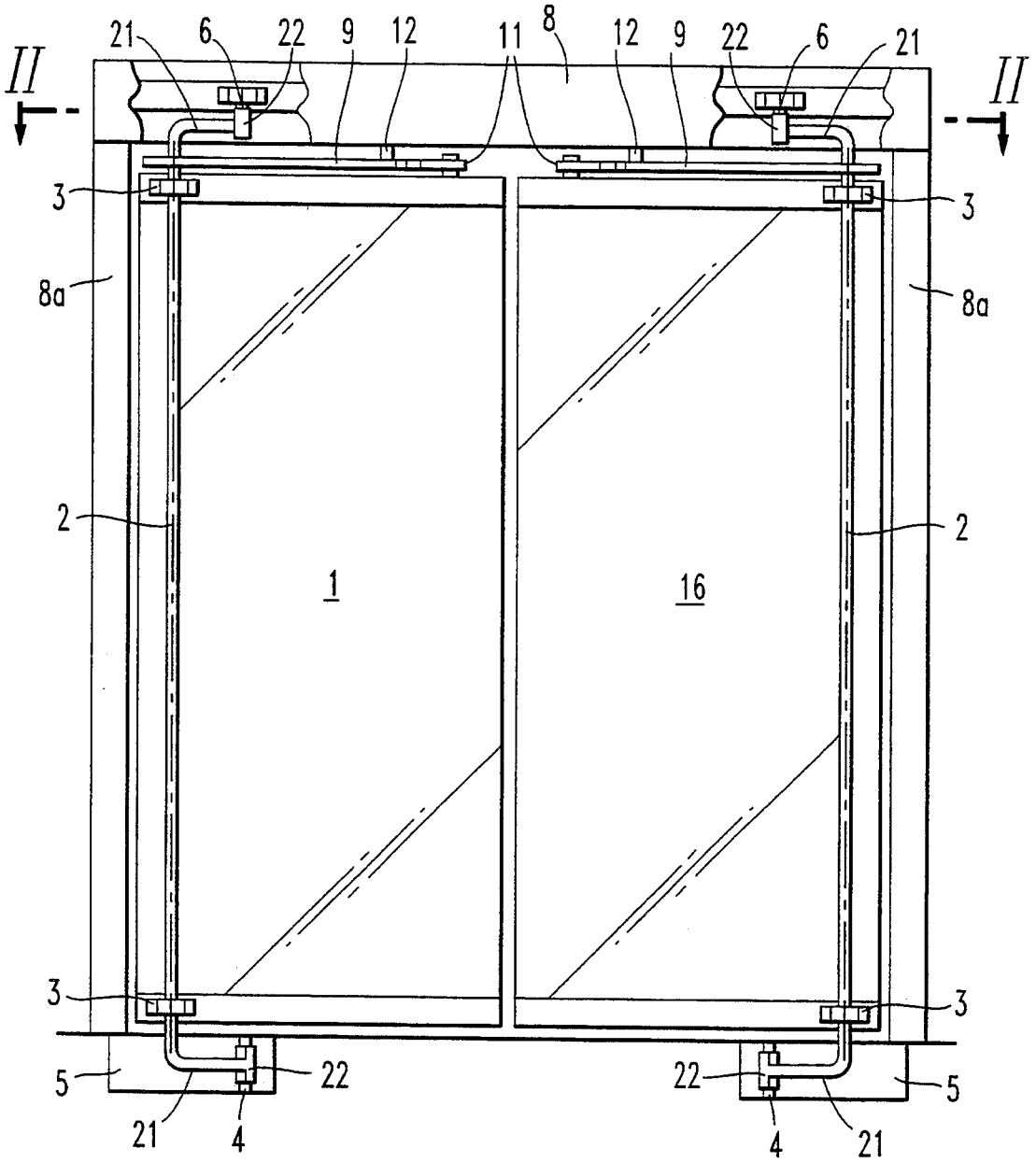
FIG. 1 shows a front view of the door assembly with the door panels in a closed position.
Figure 7:
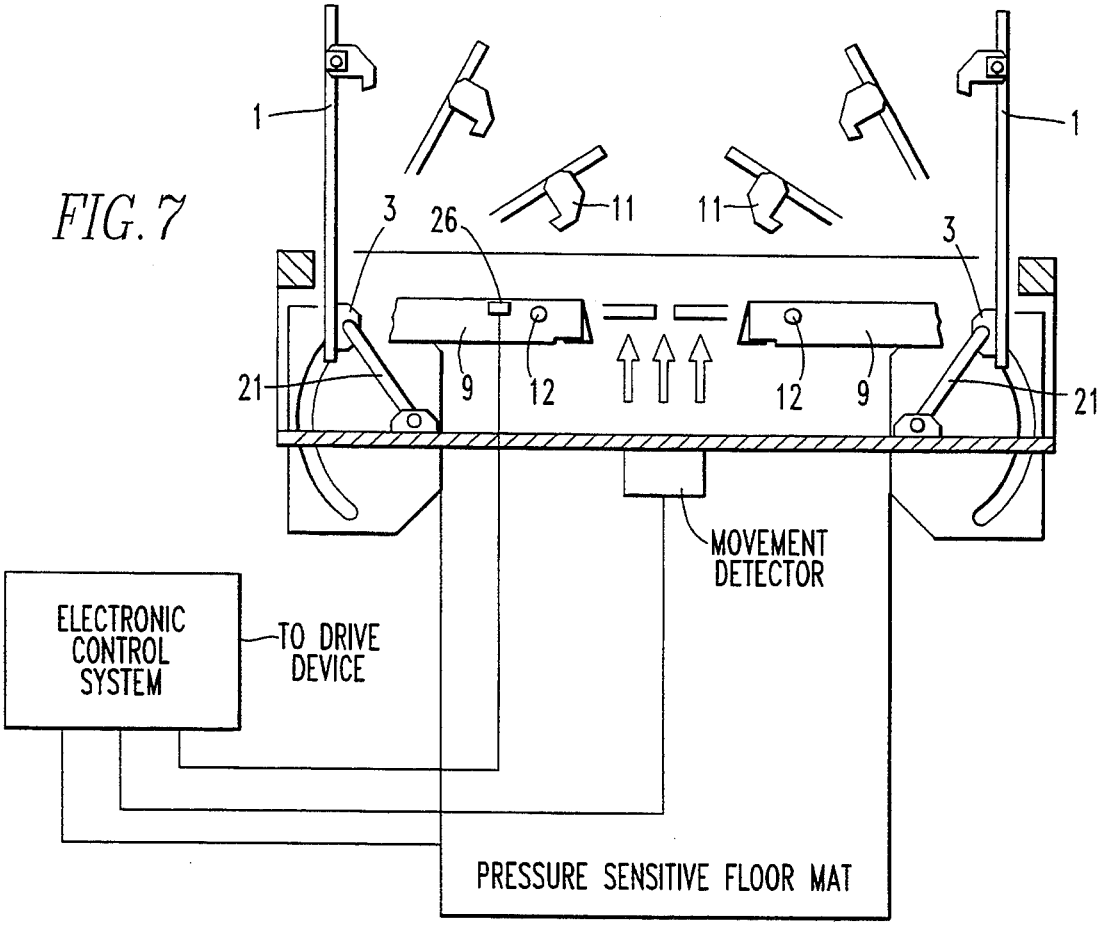
FIG. 7 shows a plan view of the door assembly in a cross section taken along Line VII—VII in FIG. 6.

FIG. 1 shows a front view of one embodiment of the door assembly according to the present invention In this embodiment the door assembly is shown with two door panels 1 and 16, both in a closed position. It should also be understood that the concepts of the present invention can also be used for a doorway in which only one door panel is needed, i.e. a left or right door represented by either door panel 1 or 16. The entire door assembly can preferable comprise a single door unit which has a top load bearing member 8, supported by two side load bearing members 8*a*. The door panels can consist of glass, or essentially any other solid material, and can be electronically connected to sensor devices for providing an automatic opening and closing of the door panels. Such sensor devices can preferably include at least one of the following: a pressure sensitive floor mat, or a motion detector, as shown in FIG. 7.

In the embodiment shown in FIG. 1, each panel 1 or 16 is being supported preferably by means of a lateral rod 2. The lateral rods 2 can preferably be hingedly connected to the top and bottom of the door panels 1 and 16 by some sort of hinge device. The hinge device can be block-like components 3, which represent quasi-bearings, or can simply be bearings which provide both a means for supporting the panels 1 and 16 on the rods 2 while also allowing the door panels 1 and 16 to pivot by means of a vertical axis of rotation, in this case the rod 2.

Each vertically-oriented rod 2 has endpieces 21, which are preferably bent to about a horizontal with respect to the vertical rod 2. In other words, the endpieces 21 can be disposed at about 90° with respect to the rod 2 to create a C-shaped structure. It is also conceivable that other degrees of angularity less than or possibly even greater than 90° can be used between the endpieces 21 and the rod 2, while angles less than 90°, such as about 30° for example would require a much greater space above and below the door. The endpieces 21 each preferably end in a hub 22. The hubs 22 can preferably be loosely, or freely installed in the lower pivots 4 and the upper pivots 6. These pivots 4 and 6, in connection with the hubs 22, essentially represent pivot bearings.

The hubs 22 and upper pivots 6, on each panel, are fastened to a load bearing structure 8 spanning the top of the door. The upper hubs 22 and pivots 6 are preferably aligned with the lower hubs 22 and pivots 4 so that an aligned axis is formed. The upper and lower hubs 22 are preferable located perpendicularly away from the door panels 1 and 16 at a distance of about 1/5 to about ⅓ of the width from the outside edge of the door panels to the inside edge of the door panels. The hub 22 connected to the lower portion of each respective panel is preferably located underneath the floor in a recess 5. The recess 5 is preferably closed by a cover 15 on top, so that the full passage width of the door in this area can be safely traversed by people walking through the doorway without there being any danger of someone stepping into the recess 15 and tripping thereover. In the cover 15 there is preferably a slot 14, which can be arc-shaped and which can extend over approximately 90°. Depending on the configuration of the door and the endpieces 21, it is also conceivable that the arc shaped slot 14 can also extend less than 90° or possibly even greater than 90°.

Above the door panels 1 and 16, there is preferably a cross strut 9 which can be oriented approximately horizontally with respect to the door. These cross struts 9 can preferably extend over a substantial portion of the width of the door panels 1 and 16, to even extend across about 100% of the width of the door. However, if for other reasons the space above the door is necessary for additional accessories, the cross struts 9 could also possibly extend across only about half of the doors width, or even less. These cross struts 9 can preferably be connected by means of hinges at a first end thereof to the vertical lateral rod 2, while the other end, near the terminal section of the strut, the cross struts can preferably be connected to some sort of drive means 13 via additional pivots 12. The drive means 13 can essentially be any type of drive means which is capable of moving an object along a substantially linear path. One possible drive means could preferably utilize some sort of carriage (not shown) into which the pivot 12 could preferably be inserted, or possibly mounted by means of a hinge (not shown). The carriage can then preferably be moved horizontally above the door by a driven motor, with possibly a chain to connect the carriage to the motor drive. If the drive means 13 is supplied with energy, the carriage would be placed in motion, and the pivot 12 would be moved horizontally above the door towards the side load bearing structure 8*a*. This movement would, in effect, push the cross strut 9 with the lateral rod 2 back towards the inside of the building along the arc shaped slot 14, and thus open the door. Each of the connections discussed above, can preferably be hinged connections as are commonly known in the art.

As shown in FIG. 2, the lateral rod 2, along with the first end of the cross struts 9 disposed on the lateral 2 are essentially connected to the door panels 1 and 16 by the block-like components 3, with the other end of the cross-struts 9 pointing toward the center of the door. The connection at the second of the cross-strut 9 to the door panels 1 and 16 can, in one embodiment, preferably be accomplished by means of an apparatus which consists of a spring plate 10, disposed on the cross strut 9, and an engaging hook-shaped components on the door panels 1 and 16. The spring plate 10 can preferably be disposed at the free end of the cross strut 9 and is preferably somewhat compressible in the direction of the door panel, or the longitudinal direction of the cross-strut. Simultaneously, the hook-shaped component 11 can be mounted on each of the door panels 1 and 16, and, in interaction with the spring plate 10, can form a separable connection between the door panel and the cross strut 9. It would also be possible to have the hook-shaped component 14 disposed on the cross strut 9, with the spring plate attached to the door panels 1 and 16.

The hook-shaped component 11 can be equipped with return spring means 25, which attempt to maintain the above-discussed interaction during normal use, and in contrast makes possible the separation of the door panels 1 and 16 from their respective cross struts 9 when pressure is applied to the inner surface of the closed door.

Figure 8:
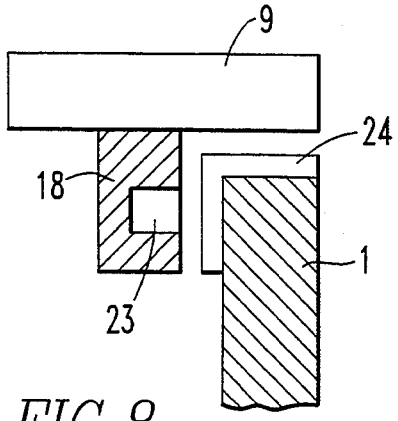
FIG. 8 shows a detail of the cross strut and door panel with a magnet engaging system.

An additional separable connection is illustrated in FIG. 8, in which a magnetic anchor plate 24 is preferably located in the upper portion of each of the door panel 1 or 16, and interacts with a permanent magnet 23 which is preferably embedded in a bracket 18. The bracket 18 is preferably fastened to the cross strut 9, which cross strut 9, as discussed above, is preferably installed above the door panels 1 and 16. Under normal operating conditions, i.e. during automatic operation, this connection would generally be secure. The connection can preferably be released by the application of a pressure force to the inside of the door panels 1 and 16, which pressure needs to be sufficient to overcome the holding force of the magnet 23.

Figure 8A:
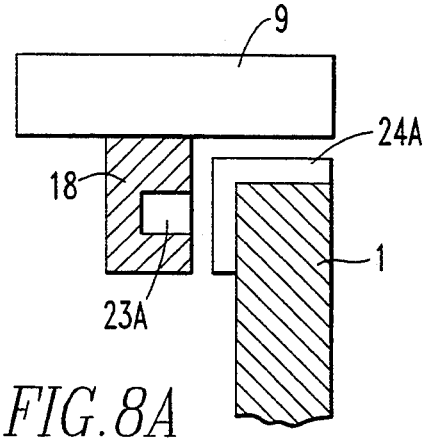
FIGS. 8A, 8B and 8C show alternative embodiments of the door assembly shown in FIG. 8.

Additionally, as shown in FIG. 8A, instead of the permanent magnet 23, an electromagnet 23A with anchor plate 24A could also be used. This electromagnet can preferably also be connected so that it is deactivated in an emergency, e.g. by means of a central control panel, so that the persons fleeing the building do not have to apply any great force to push the door panels outward. Also, during a loss in power such an electromagnet would essentially automatically be deactivated, thereby making possible the opening of the door.

Figure 8B:
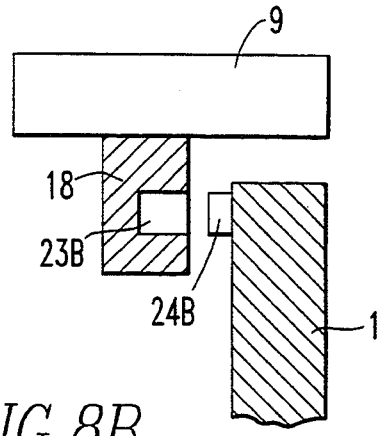
Figure 8C:
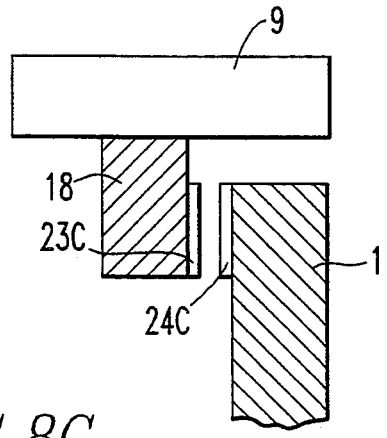

In addition to the magnetically separable connections, as shown in FIG. 8B, a locking clip 24B could be attached to one of the door panel 1 and the cross strut 9, and a catch 23B, for retaining the clip 24B, could be attached to the other of the door panel 1 and the cross strut 9. Further, economical "VELCRO" closures could also be used, as shown in FIG. 8C, wherein the "VELCRO" closure parts 23C and 24C can be disposed on the door panel 1 and cross strut 9. These types of connections represent an economical alternative to the connections conventionally used, and discussed above. If we assume that this connection will not be separated under normal conditions, and will be used only in emergencies, we can assume that it is a permanent connection, and need only be separable in the event of an emergency. In general, any type of known separable connection could be used, and the components need not necessarily be attached as discussed above, but could also be attached in a reverse manner, i.e. the magnet could be attached to the door panel 1 or 16, and the magnetic plate could be attached to the cross strut 9.

FIG. 2 shows that the pivots 12, which pivots 12 in this embodiment represent the connection to the horizontal carriages, can be located on an upper side of the cross struts 9. As a result of the drive means 13, in the manner of the prior art, the panel can either be pushed outward or inward, i.e. to execute an opening motion of a door panel or bring about a closing motion of a door panel.

In terms of function, it is apparent that when the pivots 12 slide from their central position when the door panels are closed, to the side, as moved by the carriages, the result is preferably a straight-line motion. Thus, the drive means 13, via the cross struts 9, connected by hinges to the pivot 12, can preferably bring about a combined rotation and sliding of the door panels 1 and 16. The lateral rod 2 is thereby forced to follow the curve dictated by the slot 14 in the cover 15.

Figure 4:
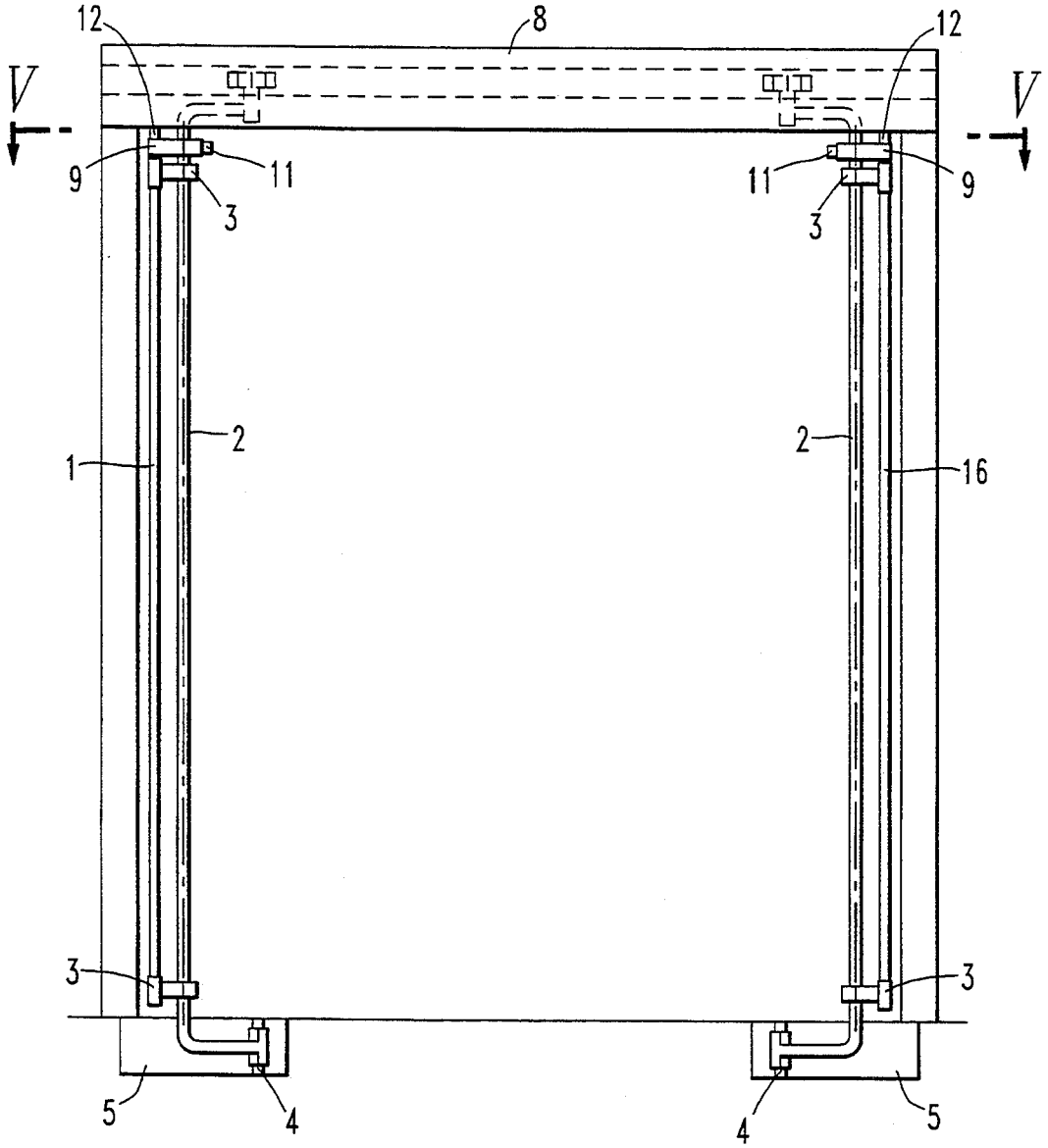
FIG. 4 shows a front view of the door assembly with the door panels in an open position.
Figure 6:
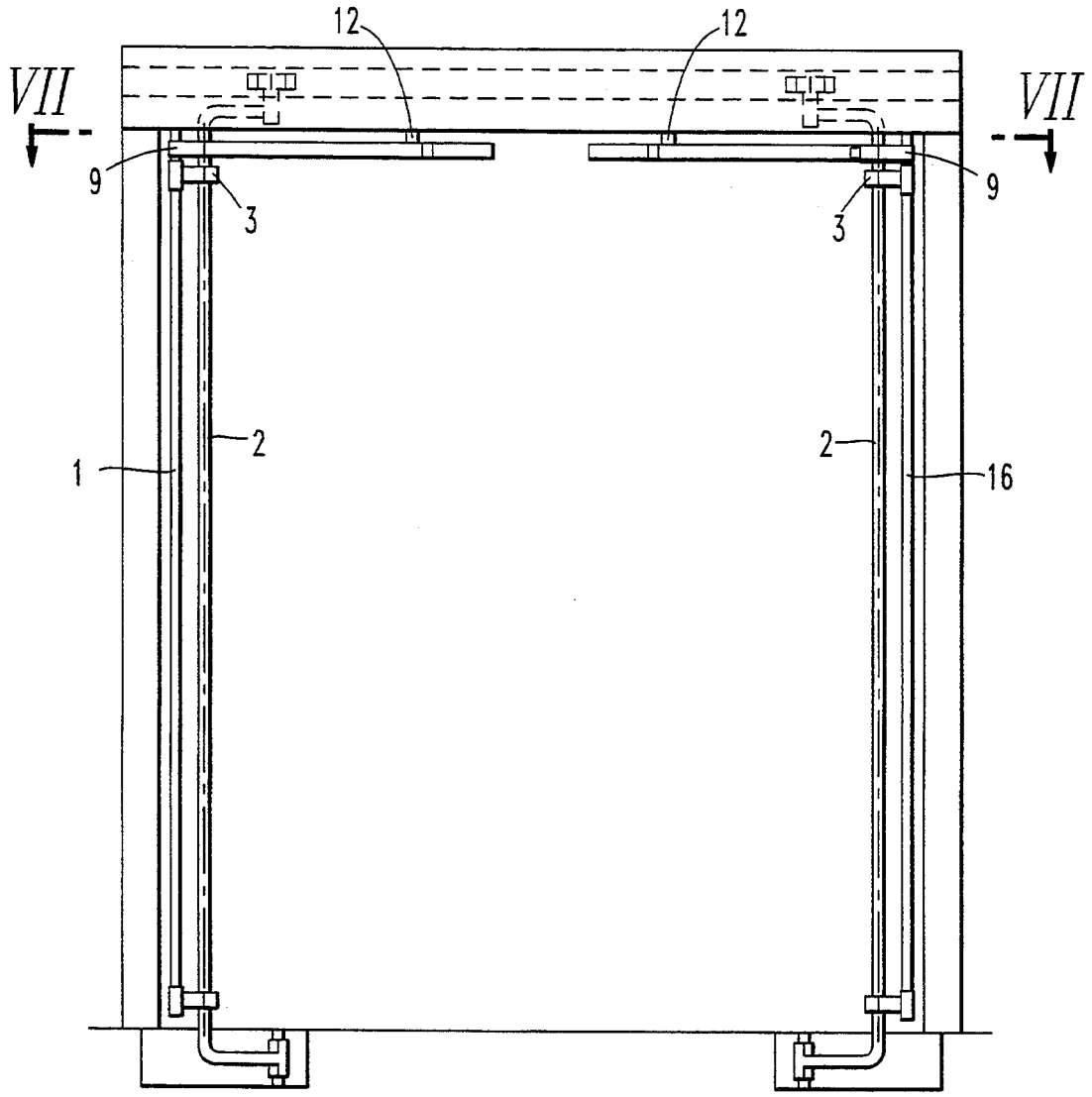
FIG. 6 shows a front view of the door assembly with the doors in an open position for an emergency.
Figure 5:
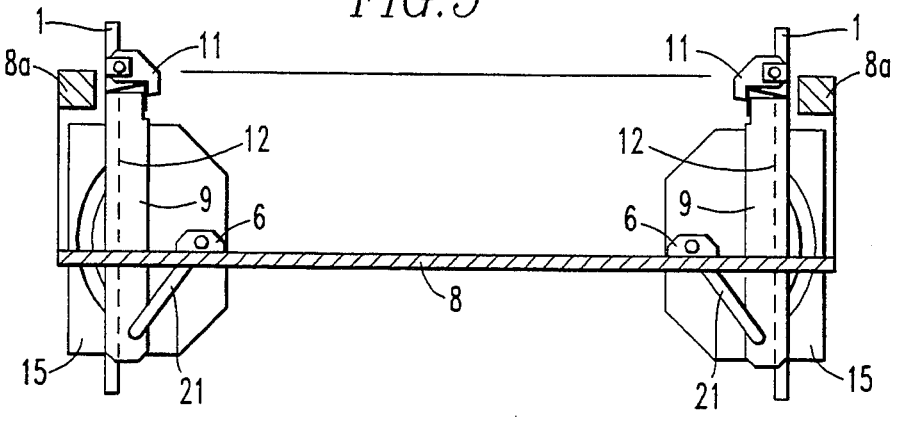
FIG. 5 shows a plan view of the door assembly in a cross section taken along Line V—V in FIG. 4.

When the carriage with the pivot 12 has reached its maximum lateral linear displacement, the open position of the door panel is reached, as shown in FIGS. 4 and 5. In this maximum lateral position, the cross strut 9 is oriented laterally, i.e. in a position which is perpendicular to its previous position, or namely parallel to the side load-bearing structures 8*a*. This is possible because both the door panels 1 and 16 and the cross strut 9 are preferably connected by hinge, or bearing devices to the rod 2. The opposite motions toward the center of the door, which are also executed by the pivots 12, are capable of bringing the panels 1 and 16 back into a position which is oriented perpendicular to the side load-bearing structure 8*a*. As a result of this motion, the door is returned to the closed position.

In one configuration of the present invention, it is also possible not to use complete vertical side rods 2. In such an embodiment, the endpieces 21 would terminate with relatively short vertical pieces that ended at the block-like components 3. Thus, a vertical axis of rotation would be created which is mounted in the vicinity of the block-like components 3, i.e. on the ends of the door panels 1 and 16 near the load-bearing structures 8*a*. As a result of this embodiment wherein the rods 2 did not traverse the vertical length of the door panels, the overall appearance of the two-panel door would not be adversely affected. In essence, the vertical axis of rotation that is created is formed by components that are almost completely disposed inside in the vicinity of the upper and lower frame members. In all other aspects, the function of this embodiment is essentially the same as the embodiment indicated in the example described above. In the vertical axis of rotation, in the present embodiment, the end-pieces 21 essentially have to be mounted so that they can rotate in the block-like components 3.

If a linear drive were not to be used on the door system described above, it would also be possible to eliminate the pivot 12 on the cross strut 9, and to have the drive means engaged at point 17. In that case, however, it would essentially be necessary to provide a fixed angle 7 between the endpieces 21 and the cross strut 9.

For example, the endpiece 21 can preferably be positively, or rigidly connected to the cross strut 9. In this case, a forced motion would be executed as a result of the rotational motion imparted by the recess 14 in the cover 15. The attachment of the door panels 1 and 16 to the cross strut 9 by means of a separable connection would preferably be retained to provide an emergency opening as discussed above.

In addition to an automatic opening of the doors, in accordance with the preceding descriptions, the door can also be opened manually because of the separable connections provided. Such a manual opening process can be performed rapidly and safely, which is particularly advantageous in emergencies which require the rapid evacuation of a room which is closed off by the door according to the invention.

The rapid evacuation of a room is made possible by the object of the invention as a result of the above-discussed separable connections. In particular, a manual opening is made possible by the special coupling provided between the cross strut 9 and the door panels 1 and 16 by the separable connections.

FIG. 7 shows that when the door panels 1 and 16 are separated from the cross strut 9, as a result of a release between the spring plate 10 and the hook-shaped component 11, the door panels 1 and 16 can preferably pivot freely around the vertical axis of rotation, or the lateral rod 2, if such a lateral rod 2 is used. This is essentially made possible by the hinged connection of the door panels 1 and 16 at the vertical axis of rotation, which hinged connection, as discussed previously can involve the bearing, or block-like component 3. Thus the door panels 1 and 16 can be pushed outward to be opened, like a normal, or swinging door. The persons inside the room can thus leave the room in a fairly simple manner, and the door can be used as an evacuation and emergency route, as it would not provide any hindrances during such an evacuation or emergency.

It should also be recalled that, due to the special embodiment and separable connection between the cross strut 9 and the door panels 1 and 16, there can also preferably be an automatic re-coupling between the cross strut 9 and the door panels 1 and 16 after a separation of a door panel 1 or 16 from a cross strut 9 has occurred. This can preferably be brought about by activating the electronic control system to rotate the endpieces 21 along the arc-shaped opening 14, to move the cross strut 9 outward, i.e. to put the cross strut 9 in the open position as if an automatic opening of the door were occurring. Such a movement of the endpieces 21 and cross struts 9 would essentially laterally pull the door panel back through the door opening towards the interior of the room and into contact with the cross strut 9. Thus automatically, by means of the separable connection, the door panels 1 and 16 would be recoupled to the cross struts 9.

FIG. 7 illustrates, in individual phases, the pivoting of the door panels 1 and 16 toward the outside upon an application of a pressure to the door panels as indicated by the arrows. An alternative approach to the embodiment as discussed immediately hereabove wherein the endpieces 21 are rotated to pull the door back along the slot 14, would be to provide an additional mechanical device to pivot the cross struts 9 outwardly toward the open door panels 1 and 16. In such a case, the pivot pins 12 would essentially need to be disengaged from the drive 13 so that the cross struts 9 could pivot outwardly.

In either of the two embodiments discussed above for re-engaging the cross struts 9 to the door panels 1 and 16, as the cross strut 9 approaches the door panels 1 and 16, there is an engagement between the spring plate 10 and the hook-shaped component 11, and the door panels are once again connected to the drive means. In the alternative embodiments wherein magnetic or "VELCRO" connections are used, similar re-engagement would result.

Figure 7A:
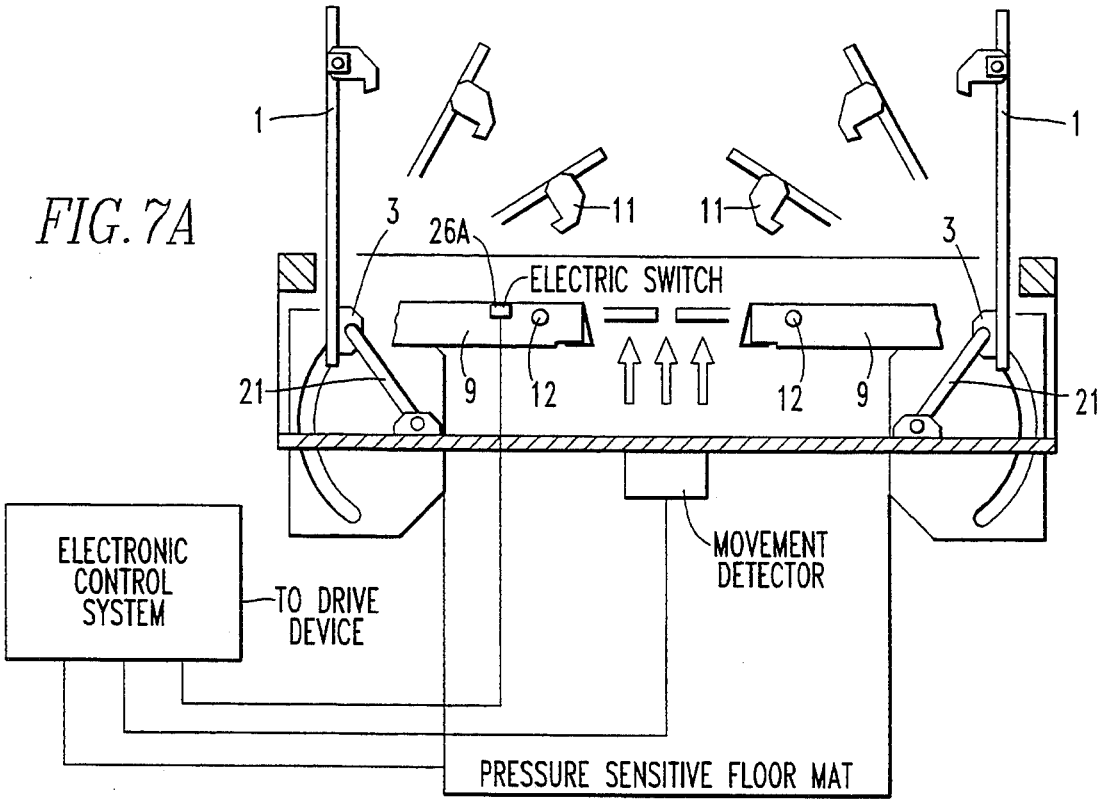
FIGS. 7A and 7B show alternative embodiments of the door assembly shown in FIG. 7.
Figure 7B:
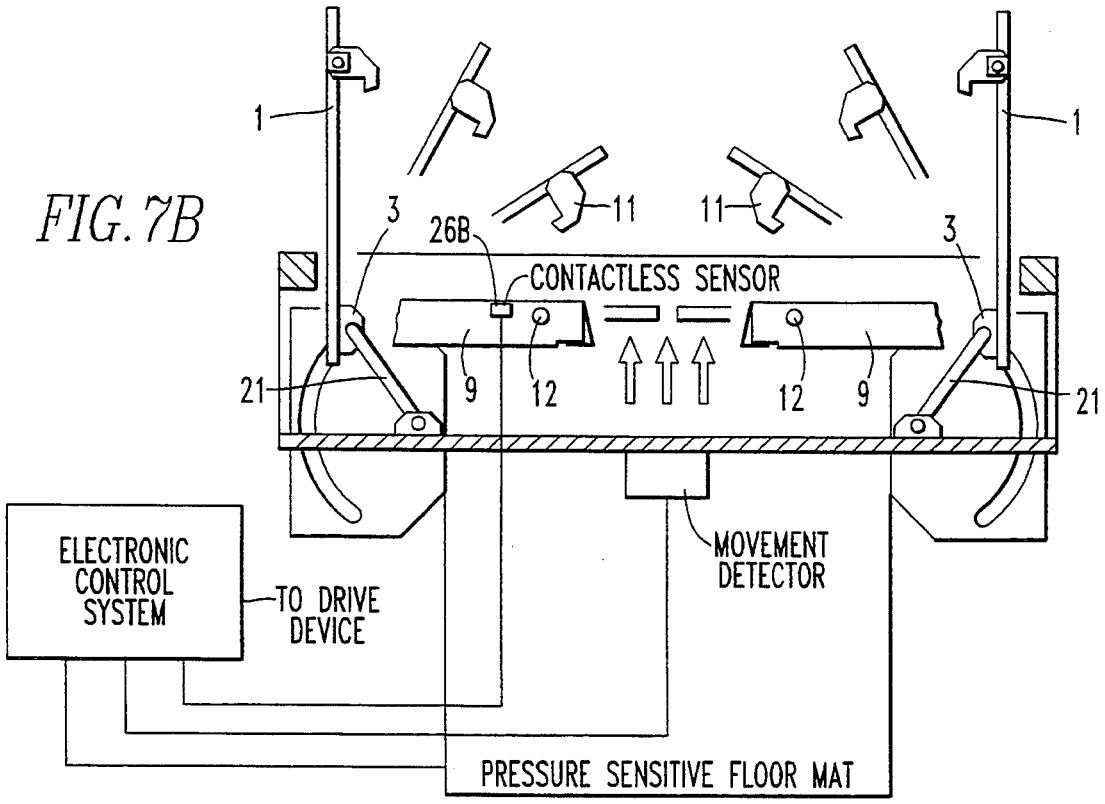

In order to provide an indication that a manual opening of the door panels has occurred, there can preferably be provided on the cross struts 9, some device 26 which is capable of reporting the current status of the door to an electronic control system. These devices 26 can be, for example, as shown in FIG. 7A, an electronic switch, such as a reed contact, or a microswitch, or as shown in FIG. 7B, possibly even a contactless sensor. Normal operation can preferably be indicated to the electronic control system when the cross strut 9 is connected to the door panel 1 or 16. But if, on account of a manual pushing of a door panel outwardly to disengage the door panel from a cross strut 9, an electrical switch or sensor 26 can preferably signal this condition to the electronic control system, which in turn can preferably start the motor drive to move the cross strut 9 outwardly until it reaches the position in which the door panels 1 and 16 again engage the cross strut 9. After the engagement or magnetic coupling has been achieved, the electrical switch or sensor 26 can then signal the recoupling, the door panels are essentially returned to a normal opening position, and the drive assembly can preferably proceed, in turn, to bring the door panels into the normal closed position so that further normal operation of the door would be possible.

In the event of a loss of power, under which conditions the door re-engagement would essentially not work, unless provided with a back-up battery power supply, the door panels could also be closed manually by simply pivoting the door panels back into their closed position. Such a closing would also allow the door panels 1 or 16 to re-engage the cross struts 9, and hinder opening from the outside.

Figure 1A:
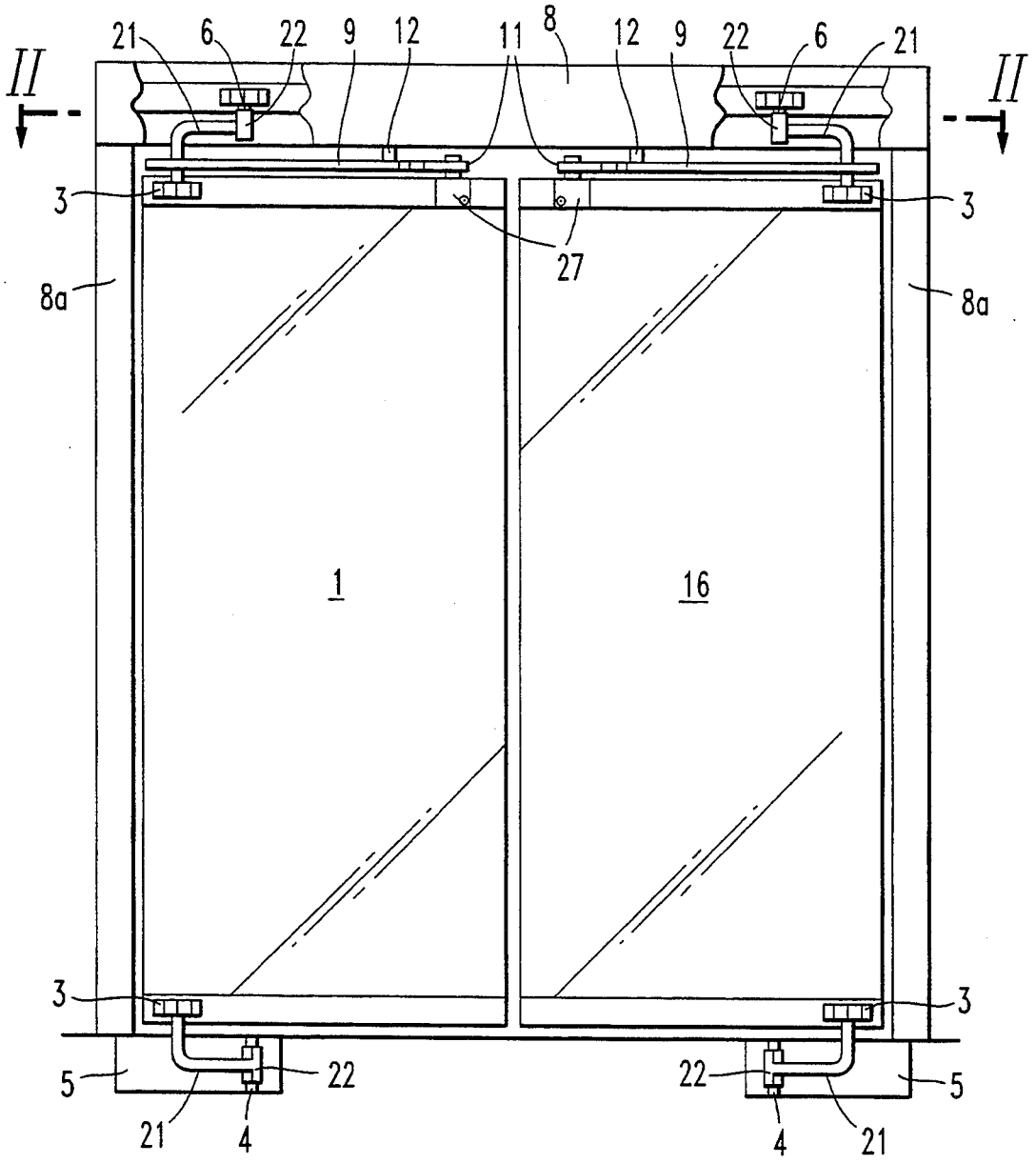
FIG. 1*a* shows the same view as in FIG. 1, but without a full vertical rod along the door panels.

To further secure the door panels in the closed position, and thereby secure the building from possible break-ins and robbery, the door panels 1 and 16 could also be equipped with additional locking devices 27, as shown in FIG. 1A, which are commonly known in the art for securing such doors. Such locking devices 27 would essentially inhibit the door panels from being pulled open from the outside, as otherwise, the door panels would only be held by their separable connections, which could possibly be separated upon a strong pull from the outside. Thus, once business hours had passed, the door panels could be locked in the closed position to keep out possible intruders.

The object of the invention thus shows that this door is suitable for use in evacuation and emergency routes, and guarantees particularly heavy-duty and reliable operation.

One feature of the invention resides broadly in a door, in particular a two-panel door, with movable door panels 1 and 16, which are equipped with means which make it possible for the door panels 1 and 16 during the opening and closing process to execute a combined sliding and rotational motion around a vertical axis, to bring the door panels 1 and 16 from a closed position in relation to the door frame into an open position in the passage direction, characterized by the fact that the vertical axis of rotation of the movable door panels 1 and 16 is located on their outer edge near the side load-bearing structure 8*a*.

Another feature of the invention resides broadly in the door, characterized by the fact that the door panels 1 and 16 are mounted top and bottom in the vicinity of the axis of rotation so that they can rotate by means of block-like components 3, from each of which a bracket 21 bent at right angles projects, which is mounted in the pivots 4 and 6.

Yet another feature of the invention resides broadly in the door, characterized by the fact that the two door panels 1 and 16 are each connected by means of hinges at their outer edge in the vicinity of the axis of rotation with a vertical rod 2, and the vertical ends of the rod 2 are bent horizontal to form a C-shaped structure, and the ends are coupled to the pivots 4 and 6 of the load-bearing structure 8 of the door.

Still another feature of the invention resides broadly in the door, characterized by the fact that on each of the door panels 1 and 16 in the upper portion on the horizontal sides, there is a cross strut 9 which is coupled in the vicinity of the axis of rotation.

Still yet another feature of the invention resides broadly in the door, characterized by the fact that during normal operation, the cross strut 9 is connected to the door panels 1 and 16, and the drive means 13 act to move the door panels 1 and 16 either outward or inward, i.e. in the opening direction or in the closing direction, as desired.

Another feature of the invention resides broadly in the door, characterized by the fact that on the cross struts 9 and/or the door panels 1 and 16, there is a separable connection, which is separated by the application of pressure on the door panels 1 and 16 from the inside to the outside, and the door panels 1 and 16 can thus swing outward.

Still another feature of the invention resides broadly in the door, characterized by the fact that the separable connection is a permanent magnet 23 with an anchor plate 24 consisting of a ferromagnetic material.

Still yet another feature of the invention resides broadly in the door, characterized by the fact that the separable connection is a switchable electromagnet with an anchor plate 24A consisting of a ferromagnetic material.

Yet another feature of the invention resides broadly in the door, characterized by the fact that the separable connection is a locking clip connection.

Another feature of the invention resides broadly in the door, characterized by the fact that the separable connection is a "VELCRO" closure.

Still another feature of the invention resides broadly in the door, characterized by the fact that the separable connection is fastened by means of the cross strut 9 on its inner end to the panels 1 and 16 by means of an elastic plate 10, which can be connected to the panels 1 and 16, and whose inner edge encloses and can be pressed against the edge, and on the elastic plate 10 a hook-shaped component 11 can be coupled, which is hinged on the panels 1 and 16 and is equipped with spring means, which make possible to maintain this coupling during normal operation, and also make possible a mutual unhinging of the two components as a result of a strong push exerted on the panel on its surface oriented toward the inside of the room when the door is closed.

Yet another feature of the invention resides broadly in the door, characterized by the fact that there are means on the cross struts 9 which indicate the operating status of the door panels 1 and 16.

Still yet another feature of the invention resides broadly in the door, characterized by the fact that the means to indicate the operating status are electrical switches.

Another feature of the invention resides broadly in the door, characterized by the fact that the means to indicate the operating status are contactless sensors.

Yet another feature of the invention resides broadly in the door, characterized by the fact that the means to indicate the operating status of the door indicate the separation of the connection between the cross struts 9 and the door panels 1 and 16 to the electronic control system, and the latter triggers an automatic reset process, which brings the door panels 1 and 16 back into contact with the cross struts 9.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A door assembly, said door assembly comprising:

door means, said door means having a length dimension with a first longitudinal edge and a second longitudinal edge disposed in said length dimension, said second longitudinal edge being spaced apart from said first longitudinal edge to define a width dimension of said door means therebetween, and said door means further having a top edge and a bottom edge, the top edge for being disposed substantially vertically above the bottom edge, and a first planar door surface and a second planar door surface;

a first structure, said first structure having a region, said door means being movable about said region of said first structure in a combination of a translational movement and a rotational movement;

means for providing the combination of the translational movement and the rotational movement of said door means about said region of said first structure to open and close said door means;

said door means having a vertical axis of rotation, said door means being further rotatable about said vertical axis of rotation;

said vertical axis of rotation being spaced apart from said region of said first structure;

said first structure defining a second vertical axis within said region of said first structure, said door means being movable about said second vertical axis in the combination of the translational movement and the rotational movement, said second vertical axis being spaced apart from said vertical axis of rotation;

said means for providing the combination of the translational movement and the rotational movement of said door means about said region of said first structure further comprises means for hingedly connecting said door means, adjacent said first longitudinal edge thereof, to said first structure for providing the combination of the translational movement and the rotational movement about said second vertical axis;

said vertical axis of rotation of said door means being disposed adjacent said first longitudinal edge;

said means for providing the combination of the translational movement and the rotational movement of said door means about said second vertical axis further comprises:

a first bearing disposed adjacent the top edge of said door means and a second bearing disposed adjacent the bottom edge of said door means, said first bearing and said second bearing being disposed adjacent said first longitudinal edge of said door means, and said first bearing and said second bearing defining said vertical axis of rotation; and at least a first pivot disposed adjacent the top edge of said door means and a second pivot disposed adjacent the bottom edge of said door means, said first pivot and said second pivot defining said second vertical axis;

said means for hingedly connecting comprises means for hingedly connecting said first pivot to said first bearing and means for hingedly connecting said second pivot to said second bearing for movement of said vertical axis of rotation about said second vertical axis;

said means for providing the combination of the translational movement and the rotational movement of said door means about said second vertical axis further comprises a vertical rod, said vertical rod having:

a central portion, a first end portion disposed adjacent a first end of said vertical rod and a second end portion disposed adjacent a second end of said vertical rod, said first end portion and said second end portion being disposed angularly with respect to said central portion to form a C-shape structure;

said central portion of said vertical rod being disposed adjacent said first planar door surface substantially between said first bearing and said second bearing; and said first end portion and said second end portion forming said means for hingedly connecting, with said first end portion of said vertical rod extending from said first bearing to said first pivot, and said second end portion of said vertical rod extending from said second bearing to said second pivot;

said means for providing the combination of the translational movement and the rotational movement of said door means about said second vertical axis further comprising:

a cross strut disposed across at least a portion of the width dimension of said door means adjacent said first planar door surface, said cross strut having a first end and a second end;

means for hingedly connecting said first end of said cross-strut to said door means at said vertical axis of rotation; and means for connecting said cross strut to said door means adjacent said second end of said cross strut.

2. The door assembly according to claim 1, wherein:

said means for providing the combination of the translational movement and the rotational movement comprises drive means for moving said cross strut to move said door means in the combination of the translational movement and the rotational movement about said second vertical axis.

3. The door assembly according to claim 2, wherein:

said means for connecting said cross strut to said door means adjacent said second end of said cross strut comprises a releasable connecting means;

said releasable connecting means being releasable upon exertion of a force against said first planar door surface to pivot said door means on said vertical axis of rotation away from said cross strut to open said door means, said pivoting of said door means on said vertical axis of rotation being independent of the combination of the translational movement and the rotational movement of said door means about said second vertical axis.

4. The door assembly according to claim 3, wherein:

said cross strut further comprises sensor means for sensing a release of said door means from said cross strut, said sensor means for producing a signal upon said sensing of the release of said door means;

said door assembly further comprises electronic control means for receiving said signal from said sensor means and activating said drive means to move said cross strut in the combination of the translational movement and the rotational movement about said second vertical axis to return said door means adjacent said cross strut; and said releasable connection being self-connectable to reconnect said door means to said cross strut upon returning said door means adjacent said cross strut.

5. The door assembly according to claim 4, further including:

means for automatically actuating said drive means to move said door means in the combination of the translational movement and the rotational movement about said second vertical axis;

said means for automatically actuating said drive means comprising sensor means for sensing a presence of a person adjacent said first planar door surfaces said sensor means for producing a signal upon said sensing of a person; and said electronic control means being for receiving said signal from said sensor means for detecting a presence of a person to actuate said drive means.

6. The door assembly according to claim 5, wherein:

said releasable connection comprises at least one of:

A) a permanent magnet attached to one of said door means and said cross strut, and a ferromagnetic anchor plate attached to the other of said door means and said cross strut, B) an electromagnet attached to one of said door means and said cross strut, and a ferromagnetic anchor plate attached to the other of said door means and said cross strut, C) a locking clip attached to one of said door means and said cross strut, and a catch for retaining said locking clip attached to the other of said door means and said cross strut, D) a VELCRO fastener, and E) an elastic plate fastened to one of said door means and said cross strut, and a hook-shaped device for engaging an edge of said elastic plate, said hook-shaped device comprising biasing means for applying a force to and biasing said hook-shaped device into engagement with the edge of said elastic plate;

said sensor means for sensing a release of said door means from said cross strut comprises one of:

an electrical switch disposed on one of the door means and the cross strut, and a contactless sensor disposed on one of the door means and the cross strut;

said sensor means for sensing a presence of a person comprises at least one of:

a motion detector, and a pressure sensitive floor mat;

said door assembly comprises a door assembly for closing off a passageway, the passageway having a floor with a first side member and a second side member extending upwardly from the floor, said first side member and said second side member defining a width of said passageway and are disposed spaced apart from one another, and said door assembly comprises two door means, with one door means disposed adjacent each of said first and said second side members, each one of said two door means for opening in a direction towards its adjacent side member;

each of said two door means having a closed position disposed transverse to said side members to close off said passageway when said door means are in a closed position, and an open position disposed parallel to said side members to open said passageway;

said first longitudinal edge of each of said door means for being disposed adjacent said side members when said two door means are in said closed position;

said second longitudinal edge of one of said two door means being disposed adjacent the second longitudinal edge of the other of said two door means when said two door means are in said closed position;

said second vertical axis being disposed spaced apart from said door means and perpendicularly to said door means at a position at about 1/5 to about ⅓ of the width of said door means from said first longitudinal edge to said second longitudinal edge;

said door means and said first and second end portions of said vertical bar defining an angle of about 40° to about 60°;

said first pivot is disposed above said top edge of said door means and said second pivot is disposed below said bottom edge of said door means;

the floor has a recess disposed adjacent each of said side members, and said second pivot disposed below said door means being disposed in said recess;

said door assembly further comprises:

plate means for covering said recess, said plate means having an arcuate slot therein, said arcuate slot for guiding said vertical rod to cause at least a part of the combined translational motion and rotational motion;

said arcuate slot extending around said second vertical axis and through an angle of about 90° with respect to said second vertical axis;

a load bearing member for being disposed across the passageway parallel to door means in the closed position, said second pivot being disposed on said load bearing member;

said first end portion and said second end portion of said vertical rod are disposed at about 90° with respect to said central portion of said vertical rod;

said first end portion and said second end portion each have a terminal end, said terminal end comprising a hub, said hub comprising a pivot pin disposed therein, said door means being pivotable on said pivot pins;

said cross strut comprises guide means disposed adjacent said second end of said cross strut, said guide means for engaging said drive means for movement of said guide means along a linear path in a direction parallel to said load bearing member;

said drive means comprises linear drive means for moving said guide means along said linear path to push said door means along said arcuate path; and said door assembly further comprises lock means for locking said door panels to said cross struts, to secure said door means in the closed position.

7. A door assembly, said door assembly comprising:

door means, said door means having a length dimension with a first longitudinal edge and a second longitudinal edge disposed in said length dimension, said second longitudinal edge being spaced apart from said first longitudinal edge to define a width dimension of said door means therebetween;

a first structure, said first structure having a region, said door means being movable about said region of said first structure;

means for providing a signal to automatical open and close said door means;

means for moving said door means about said region of said first structure to automatically open and close said door means in response to said signal;

means for releasably engaging said door means with said means for moving said door means to move said door means about said first region during engagement of said door means with said means for moving;

said door means having a vertical axis of rotation, said vertical axis of rotation being spaced apart from said region of said first structure;

said door means being further rotatable about said vertical axis of rotation upon disengagement of said door means from said means for moving to manually open and close said door means;

said first structure defining a second vertical axis within said region of said first structure, said means for moving said door means being configured for moving said door means about said second vertical axis in a combination of a translational movement and a rotational movement, said second vertical axis being spaced apart from said vertical axis of rotation;

said means for moving said door means comprising means for hingedly connecting said door means adjacent said first longitudinal edge to said first structure for providing the combination of the translational movement and the rotational movement about said second vertical axis;

said vertical axis of rotation of said door means being disposed adjacent said first longitudinal edge of said door means;

said means for moving said door means about said second vertical axis further comprises:

a cross strut disposed across at least a portion of the width dimension of said door means adjacent said first planar door surface, said cross strut having a first end and a second end;

means for hingedly connecting said first end of said cross-strut to said door means at said vertical axis of rotation; and said means for releasably engaging said door means with said means for moving said door means comprises means for releasably engaging said door means with said second end of said cross strut, said means for releasably engaging being releasable upon application of a force against said first planar door surface to pivot said door means on said vertical axis of rotation away from said cross strut to open said door means, said pivoting of said door means on said vertical axis of rotation being independent of the moving of said door means in the combination of the translational movement and the rotational movement of said door means about said second vertical axis.

8. The door assembly according to claim 7, wherein:

said door means has a top edge and a bottom edge, the top edge for being disposed substantially vertically above the bottom edge, and a first planar door surface and a second planar door surface;

said means for moving said door means further comprises:

a first bearing disposed adjacent the top edge of said door means and a second bearing disposed adjacent the bottom edge of said door means, said first bearing and said second bearing being disposed adjacent said first longitudinal edge of said door means, and said first bearing and said second bearing defining said vertical axis of rotation; and at least a first pivot disposed adjacent the top edge of said door means and a second pivot disposed adjacent the bottom edge of said door means, said first pivot and said second pivot defining said second vertical axis; and said means for hingedly connecting comprises a vertical rod, said vertical rod having:

a central portion, a first end portion disposed adjacent a first end of said vertical rod and a second end portion disposed adjacent a second end of said vertical rod, said first end portion and said second end portion being disposed angularly with respect to said central portion to form a C-shape structure;

said central portion of said vertical rod being disposed adjacent said first planar door surface substantially between said first bearing and said second bearing; and said first end portion and said second end portion forming said means for hingedly connecting, with said first end portion of said vertical rod extending from said first bearing to said first pivot, and said second end portion of said vertical rod extending from said second bearing to said second pivot.

9. The door assembly according to claim 8, wherein:

said cross strut further comprises sensor means for sensing a release of said door means from said cross strut, said sensor means for producing a signal upon said sensing of the release of said door means;

said door assembly further comprises electronic control means for receiving said signal from said sensor means and activating said drive means to move said cross strut in the combination of the translational movement and the rotational movement about said second vertical axis to return said door means adjacent said cross strut;

said means for releasably engaging said door means to said cross strut being self-connectable to reconnect said door means to said cross strut upon returning said door means adjacent said cross strut;

said means for releasably engaging comprises at least one of:

A) a permanent magnet attached to one of said door means and said cross strut, and a ferromagnetic anchor plate attached to the other of said door means and said cross strut, B) an electromagnet attached to one of said door means and said cross strut, and a ferromagnetic anchor plate attached to the other of said door means and said cross strut, C) a locking clip attached to one of said door means and said cross strut, and a catch for retaining said locking clip attached to the other of said door means and said cross strut, D) a VELCRO fastener, and E) an elastic plate fastened to one of said door means and said cross strut, and a hook-shaped device for engaging an edge of said elastic plate, said hook-shaped device comprising biasing means for applying a force to and biasing said hook-shaped device into engagement with the edge of said elastic plate; and said means for providing a signal to automatically open and close said door means comprises sensor means for sensing a presence of a person adjacent said first planar door surface, said sensor means for producing a signal upon said sensing of a person;

said electronic control system being for receiving said signal from said sensor means for detecting a presence of a person and providing said signal to automatically open and close said door means, drive means;

said sensor means for sensing a person comprising at least one of:

a motion detector, and a pressure sensitive floor mat;

said sensor means for sensing a release of said door means from said cross strut comprising one of:

an electrical switch, and a contactless sensor;

said door assembly comprises a door assembly for closing off a passageway, the passageway having a floor with a first side member and a second side member extending upwardly from the floor, said first side member and said second side member defining a width of said passageway and being disposed spaced apart from one another, and said door assembly comprises two door means, one of said two door means being disposed adjacent each of said first side member and said second side member, each one of said two door means for opening in a direction towards its adjacent side member;

each of said two door means having a closed position disposed transverse to said side members to close off said passageway when said door means are in a closed position, and an open position disposed parallel to Said side members to open said passageway;

said first longitudinal edge of each of said door means for being disposed adjacent said side members when said-two door means are in said closed position;

said second longitudinal edge of one of said two door means being disposed adjacent the second longitudinal edge of the other of said two door means when said two door means are in said closed position;

said door means and said first and second end portions of said vertical bar defining an angle of about 40° to about 60°;

said first pivot is disposed above said top edge of said door means and said second pivot is disposed below said bottom edge of said door means;

the floor has a recess disposed adjacent each of said side members, and said second pivot disposed below said door means being disposed in said recess;

said door assembly further comprises:

plate means for covering said recess, said plate means having an arcuate slot therein, said arcuate slot for guiding said vertical rod to cause at least a part of the combined translational motion and rotational motion;

said arcuate slot extending around said second vertical axis and through an angle of about 90° with respect to said second vertical axis;

a load bearing member for being disposed across the passageway parallel to door means in the closed position, said second pivot being disposed on said load bearing member;

said first end portion and said second end portion of said vertical rod are disposed at about 90° with respect to said central portion of said vertical rod;

said first end portion and said second end portion each have a terminal end, said terminal end comprising a hub, said hub comprising a pivot pin disposed therein, said door means being pivotable on said pivot pins.

10. A method for operating a door assembly, said method comprising the steps of:

providing door means, said door means having a length dimension with a first longitudinal edge and a second longitudinal edge disposed in said length dimension, said second longitudinal edge being spaced apart from said first longitudinal edge to define a width dimension of said door means therebetween, said door means having a top edge and a bottom edge, the top edge for being disposed substantially vertically above the bottom edge, and a first planar door surface and a second planar door surface;

providing a first structure said first structure having a region, said door means being movable about said region of said first structure in a combination of a translational movement and a rotational movement;

providing means for moving said door means in the combination of the translational movement and the rotational movement of said door means about said region of said first structure to open and close said door means;

providing a vertical axis of rotation adjacent said door means;

providing means for further rotating said door means about said vertical axis of rotation, and said vertical axis of rotation being spaced apart from said region of said first structure;

moving said door means in the combination of the translational movement and the rotational movement of said door means about said region of said first structure, and in the rotational movement of said door means about said vertical axis of rotation to open and close said door means;

providing means for generating a signal during a presence of a person adjacent said door means and terminating said signal upon said person moving away from said door means;

providing means for receiving said signal from said means for generating said signal to automatically activate said means for moving said door means in the combination of the translational movement and the rotational movement of said door means about said region of said first structure to open and close said door means;

generating said signal upon detecting the presence of a person adjacent the door means to automatically move said door means in the combination of the translational movement and the rotational movement about said region of said first structure to open said door means upon generating said signal;

terminating said signal upon the person moving away from said door means to automatically move said door means in the combination of the translational movement and the rotational movement about said region of said first structure to close said door means upon terminating said signal;

providing means for releasably connecting said door means to said means for moving said door means in the combination of the translational movement and the rotational movement about said region of said first structure;

releasing said door means from said means for moving said door means to provide said rotational movement of said door means about said vertical axis of rotation;

manually rotating said door means about said vertical axis of rotation to open said door means;

said providing means for moving said door means further comprises:

providing a first bearing disposed adjacent the top edge of said door means adjacent said first longitudinal edge and a second bearing disposed adjacent the bottom edge of said door means adjacent said first longitudinal edge, said first bearing and said second bearing defining said vertical axis of rotation;

providing at least a first pivot disposed adjacent the top edge of said door means and a second pivot disposed adjacent the bottom edge of said door means, said first pivot and said second pivot defining a second vertical axis within said region of said first structure;

providing a vertical rod, said vertical rod having a central portion, a first end portion disposed adjacent a first end of said vertical rod and a second end portion disposed adjacent a second end of said vertical rod, said first end portion and said second end portion being disposed angularly with respect to said central portion to form a C-shape structure; and disposing said central portion of said vertical rod adjacent said first planar door surface substantially between said first bearing and said second bearing with said first end portion extending from said first bearing to said first pivot, and said second end portion of said vertical rod extending from said second bearing to said second pivot; said process further comprises:

moving said door means with said vertical rod on said first pivot and said second pivot to provide said combination of said translational and rotational movement of said door means about said second vertical axis; and rotating said door means about said vertical rod on said first bearing and said second bearing to provide said rotational movement about said vertical axis of rotation;

said providing means for moving further comprises:

providing a cross strut across at least a portion of the width of said door means, said cross strut having a first end and a second end;

providing, on said second end of said cross strut, said means for releasably connecting said door means to said means for moving;

providing means for hingedly connecting said first end of said cross strut to said vertical bar;

providing drive means to move said cross strut to move said door means in the combination of the translational movement and the rotational movement when said second end of said cross strut is connected to said door means;

said process further comprises:

providing sensor means for sensing a release of said cross strut from said door means;

producing a second signal when said cross-strut is released from said door means;

receiving said second signal with electronic control means;

producing a third signal with said electronic control means to move said cross strut in the combination of the translational movement and the rotational movement to return said door means adjacent said cross strut;

reengaging said door means with said cross strut;

said providing means for releasably connecting comprises providing at least one of:

A) a permanent magnet attached to one of said door means and said cross strut, and a ferromagnetic anchor plate attached to the other of said door means and said cross strut, B) an electromagnet attached to one of said door means and said cross strut, and a ferromagnetic anchor plate attached to the other of said door means and said cross strut, C) a locking clip attached to one of said door means and said cross strut, and a catch for retaining said locking clip attached to the other of said door means and said cross strut, D) a VELCRO fastener, and E) an elastic plate fastened to one of said door means and said cross strut, and a hook-shaped device for engaging an edge of said elastic plate, said hook-shaped device comprising biasing means for applying a force to and biasing said hook-shaped device into engagement with the edge of said elastic plate;

said providing sensor means for sensing a release of said cross strut from said door means comprises providing at least one of:

an electrical switch disposed on one of the door means and the cross strut, and a contactless sensor disposed on one of the door means and the cross strut;

said providing means for generating a signal during a presence of a person adjacent said door means and terminating said signal upon said person moving away from said door means comprises providing at least one of:

a motion detector, and a pressure sensitive floor mat; and said moving said door means in the combination of the translational movement and rotational movement comprises moving said vertical axis of rotation along an arcuate path through about 90° around said second vertical axis.

* * * * *

UNITED STATES PATENT AND TRADEMARK OFFICE

CERTIFICATE OF CORRECTION

PATENT NO. : 5,369,912

DATED : December 6, 1994

INVENTOR(S) : Lothar GINZEL and Giovanni BERTOLDO

It is certified that error appears in the above-indentified patent and that said Letters Patent is hereby corrected as shown below:

On the title page, after item [22], insert the following Continuing Application Data: insert item [63], --Related U.S. Application Data Continuation-in-part of International Application No. PCT/DE92/00707, filed on August 25, 1992.--.

In column 5, line 33, after '6;' delete "and".

In column 14, line 55, Claim 5, before 'said', delete "surfaces" and insert --surface,--.

In column 19, line 8, Claim 9, after 'when', delete "said-two" and insert --said two--.

In column 21, line 37, Claim 10, after 'said', delete "cross-strut" and insert --cross strut--.

Signed and Sealed this

Twenty-fourth Day of December, 1996

*Attest:*

Bruce Lehman

BRUCE LEHMAN

*Attesting Officer*

*Commissioner of Patents and Trademarks*